US008485208B2

(12) United States Patent
Seo

(10) Patent No.: US 8,485,208 B2
(45) Date of Patent: Jul. 16, 2013

(54) CANOPY TENT

(76) Inventor: Jung Woo Seo, Seoul (KR)

( * ) Notice: Subject to any disclaimer, the term of this patent is extended or adjusted under 35 U.S.C. 154(b) by 63 days.

(21) Appl. No.: 13/128,294

(22) PCT Filed: Nov. 18, 2009

(86) PCT No.: PCT/KR2009/006810

§ 371 (c)(1),
(2), (4) Date: May 9, 2011

(87) PCT Pub. No.: WO2010/064798

PCT Pub. Date: Jun. 10, 2010

(65) Prior Publication Data

US 2011/0214706 A1 Sep. 8, 2011

(30) Foreign Application Priority Data

Dec. 1, 2008 (KR) ..... 10-2008-0120589
Apr. 6, 2009 (KR) ..... 10-2009-0029521

(51) Int. Cl.
*E04H 15/36* (2006.01)

(52) U.S. Cl.
USPC ..... 135/135; 135/98; 135/147; 135/156; 403/64; 403/171; 52/646

(58) Field of Classification Search
USPC ... 135/124, 135, 147, 156–159, 120.3–120.4, 135/905, 98; 403/64, 170, 173–174, 217–219; 52/86, 81.2, 81.3, 646, 656
See application file for complete search history.

(56) References Cited

U.S. PATENT DOCUMENTS 4,202,363 A * 5/1980 Watts et al. ..... 135/98
5,230,358 A * 7/1993 Forell ..... 135/98
5,333,634 A * 8/1994 Taylor ..... 135/98

(Continued)

FOREIGN PATENT DOCUMENTS

KR 20-0172539 12/1999
KR 20-0182874 3/2000

(Continued)

*Primary Examiner* — Winnie Yip
(74) *Attorney, Agent, or Firm* — Occhiuti Rohlicek & Tsao LLP

(57) ABSTRACT

The present invention relates to a connection device installed on a top of a canopy tent, comprising: a main body having a hollow interior, a sliding member having an interior with a downwardly protruding cylinder, support poles each having one end hinged to the main body, and the other end connected to a tent pole for standing the tent fabric upright, a joint bar having one end hinged to the sliding member, and the other end having one side hinged to a first connection bar hinged to the support pole and the other side hinged to a second connection bar hinged to the main body; The hollow interior of the main body is equipped with a compression spring and a spring holder. The cylinder of the sliding member is fitted into the hollow interior of the main body from the top of the hollow interior to be movable in the upward and downward directions to set up or taken of the tent canopy.

5 Claims, 8 Drawing Sheets

U.S. PATENT DOCUMENTS

| | | | | |
|---|---|---|---|---|
| 5,499,646 | A * | 3/1996 | Lee | 135/121 |
| 6,581,617 | B2 * | 6/2003 | Ham et al. | 135/135 |
| 6,679,643 | B1 * | 1/2004 | Ham | 403/102 |
| 6,802,329 | B2 * | 10/2004 | Chen | 135/135 |
| 7,607,447 | B1 * | 10/2009 | Han | 135/135 |
| 7,861,736 | B2 * | 1/2011 | Choi | 135/143 |
| 8,047,218 | B1 * | 11/2011 | Shin | 135/135 |
| 2007/0051398 | A1 * | 3/2007 | Kim | 135/135 |
| 2007/0131265 | A1 * | 6/2007 | Choi | 135/135 |

FOREIGN PATENT DOCUMENTS

| | | |
|---|---|---|
| KR | 20-0339799 | 1/2004 |
| KR | 10-2004-0058126 | 7/2004 |
| KR | 10-2005-0117718 | 12/2005 |
| KR | 10-0761454 | 9/2007 |
| KR | 20-2008-0002625 | 7/2008 |

* cited by examiner

PRIOR ART

CANOPY TENT

CROSS-REFERENCE TO RELATED APPLICATIONS

This application is the National Stage of International Application No. PCT/KR2009/006810, filed on Nov. 18, 2009, which claims the priority date of Korean Application 10-2008-0120589, filed on Dec. 1, 2008, and Korean Application 10-2009-0029521, filed on Apr. 6, 2009, the contents of which is being hereby incorporated by reference in their entirety.

BACKGROUND OF THE INVENTION

1. Field of the Invention

The present invention relates to a canopy tent, and more particularly, to a canopy tent, which is easy to be installed and dismantled by an elastic force of a compression spring arranged in a connection device mounted on the top of the tent and by an elastic force of tent poles connected to support poles.

2. Background Art

In general, canopy tents are called "collapsible tents" or "folding tents", and means tents, which can be installed and dismantled while support poles and tent poles constituting a tent frame are expanded or collapsed.

Recently, automatic umbrella style canopy tents configured to be rapidly and easily pitched or closed in a manner similar to the motion of a conventional automatic umbrella have been developed.

As shown in FIG. 1, one of the conventional automatic umbrella style canopy tents includes: a connection member 1 mounted on the top of the tent; a plurality of support poles 2 radially hinge-coupled to the connection member 1 to form the outward appearance of the tent; and a guide shaft 3 vertically connected to a lower portion of the connection member 1.

A compression spring 4 and a cylindrical elevation guide 5 are fit onto the outer face of the guide shaft 3 in order. The elevation guide 5 receives a downward-direction movement force by the compression spring 4, and a stopper 6 is screw-fastened to a lower end of the guide shaft 3 in order to prevent a separation of the elevation guide 5 from the guide shaft 3. Here, a plurality of auxiliary support poles are radially hinge-coupled to the elevation guide 5, and then, are hinge-coupled to the support poles 5 one-to-one.

As described above, in the case that the elevation guide 5 is pulled downwardly or the support poles 2 are expanded outwardly, the conventional automatic umbrella style canopy tent is installed when the support poles 2 are expanded and the expanded support poles 2 are supported by the auxiliary poles 7 while the elevation guide 5 automatically moves downwardly along the guide shaft 3 by a restoring force of the compression spring 4.

In this instance, because a strong descending force is applied to the elevation guide 5 by the restoring force of the compression spring 4 and a connection end portion of the auxiliary support pole 7 connected with the elevation guide 5 is located lower than a connection end portion connected with the support pole 2, the expanded support poles 2 are not folded again and can keep the expanded state in a lock condition.

In the above state, when the compression spring 4 folds the support poles 2 with a power greater than the restoring force, the auxiliary support pole 7 applies an ascending force to the support poles 2, and hence, the elevation guide 5 moves upwardly along the guide shaft 3 while contracting the compression spring 4, so that the tent can be dismantled.

However, the conventional automatic umbrella style canopy tent is configured in such a way as to be installed while the auxiliary support pole 7 is expanded horizontally and to be dismantled while the auxiliary support pole 7 is folded vertically, and hence, an elevation height (h) of the elevation guide 5 becomes longer because a rotational angle of the auxiliary support pole 7 is increased.

Therefore, as the elevation height of the elevation guide 5 becomes longer, a height of the tent is reduced and the interior space of the tent becomes narrower, and hence, it requires a user's excessive operation force when the tent is installed or dismantled.

Moreover, because the compression spring 4 is exposed to the outside, the user may be injured while installing or dismantling the tent, and the tent may not be installed or dismantled smoothly when the compression spring 4 is corroded.

SUMMARY OF THE INVENTION

Accordingly, the present invention has been made to solve the above-mentioned problems occurring in the prior arts, and it is an object of the present invention to provide a canopy tent, which can be rapidly and easily installed and dismantled by an elastic force of a compression spring disposed in a connection device mounted on the top of the tent and by an elastic force of tent poles connected to support poles.

It is another object of the present invention to provide a canopy tent, which includes a plurality of poles constituting a frame of the tent, first and second joint members for connecting the poles with each other, and a flexure preventing pipe mounted between the first joint member and the second joint member to prevent the installed tent from being collapsed by the external force or stumbled by a draft of air.

To accomplish the above object, according to the present invention, there is provided a canopy tent including: a main body having a plurality of joint rings formed on the outer surface thereof and a hollow interior; a sliding member having a plurality of joint rings formed on the outer surface thereof and a downwardly protruding cylinder formed therein; support poles, each having one end, which is hinge-coupled to the joint ring of the main body, and the other end, which is connected to a tent pole for standing the tent fabric upright, and which has a joint ring formed on the outer face of a pole connection portion; and a joint bar having one end, which is hinge-coupled to the joint ring of the sliding member, and the other end, which has one side hinge-coupled to a first connection bar hinge-coupled to the joint ring of the support pole and the other side hinge-coupled to a second connection bar hinge-coupled to the joint ring of the main body, wherein the hollow interior of the main body is equipped with a compression spring and a spring holder, the spring holder is coupled to the lower portion of the cylinder, and the cylinder of the sliding member is fitted into the hollow interior of the main body from the top of the hollow interior such that the cylinder is movable in the upward and downward directions.

Moreover, the sliding member further includes a retaining portion, which is formed on a side of the lower end portion thereof in such a way that a stopper is caught thereto, and a fastening ring, which is formed on the outer surface of the main body for fixing the stopper thereto.

Furthermore, a cover is connected to the top of the sliding member, and the cover has a through hole formed on the upper face thereof to allow a user to connect a cord to the retaining ring formed on one side of the stopper caught to the retaining portion of the sliding member to thereby release the stopper.

Additionally, the spring holder includes a through hole to allow the user to insert a cord into the through hole to form a ring so that the user can install the tent by downwardly pulling the ring.

In addition, each of the poles includes: a first pole having one end hinge-coupled with the connection device located on the top of the tent and the other end joined to the first joint member; a plurality of second poles, each having one end joined to the first joint member and the other end fixed to the second joint member; a plurality of third poles, each having one end joined to the second joint member and the other end fixed to the fixing member; and a flexure preventing pipe mounted on the outer face of the second pole for preventing flexure of the second pole, wherein the fixing member is joined with the third pole and has a T-shaped through hole to which a fixing ring mounted at an edge of the lower end portion of the tent fabric is inserted and fixed thereinto.

As described above, the canopy tent according to the present invention can be rapidly and easily installed by the elastic force of the compression spring disposed in the connection device and by the elastic force of the poles connected to the support poles and can be rapidly dismantled by the poles, which are folded in a direction of the central axis of the connection device mounted at the top of the tent.

Furthermore, the canopy tent according to the present invention is prevented from being collapsed by the external force or stumbled by a draft of air because it includes the flexure preventing pipe mounted on the outer face of each pole.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Reference will be now made in detail to the preferred embodiments of the present invention, which can be easily embodied by those skilled in the art, with reference to the attached drawings.

Figure 1:
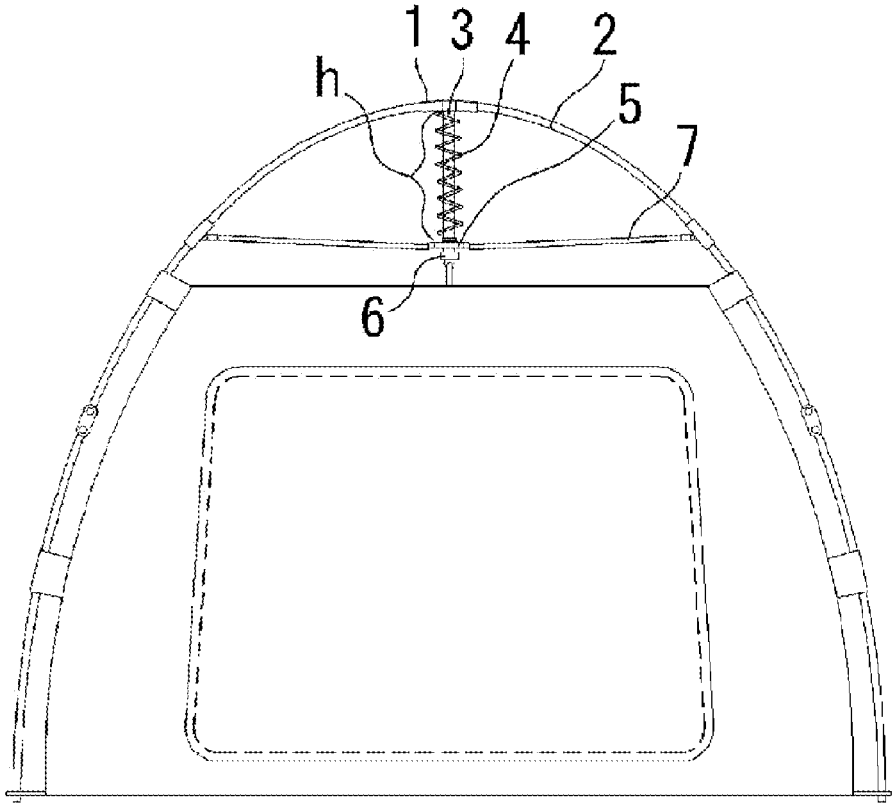
FIG. 1 is a view showing an example of the use of a conventional canopy tent.
Figure 2:
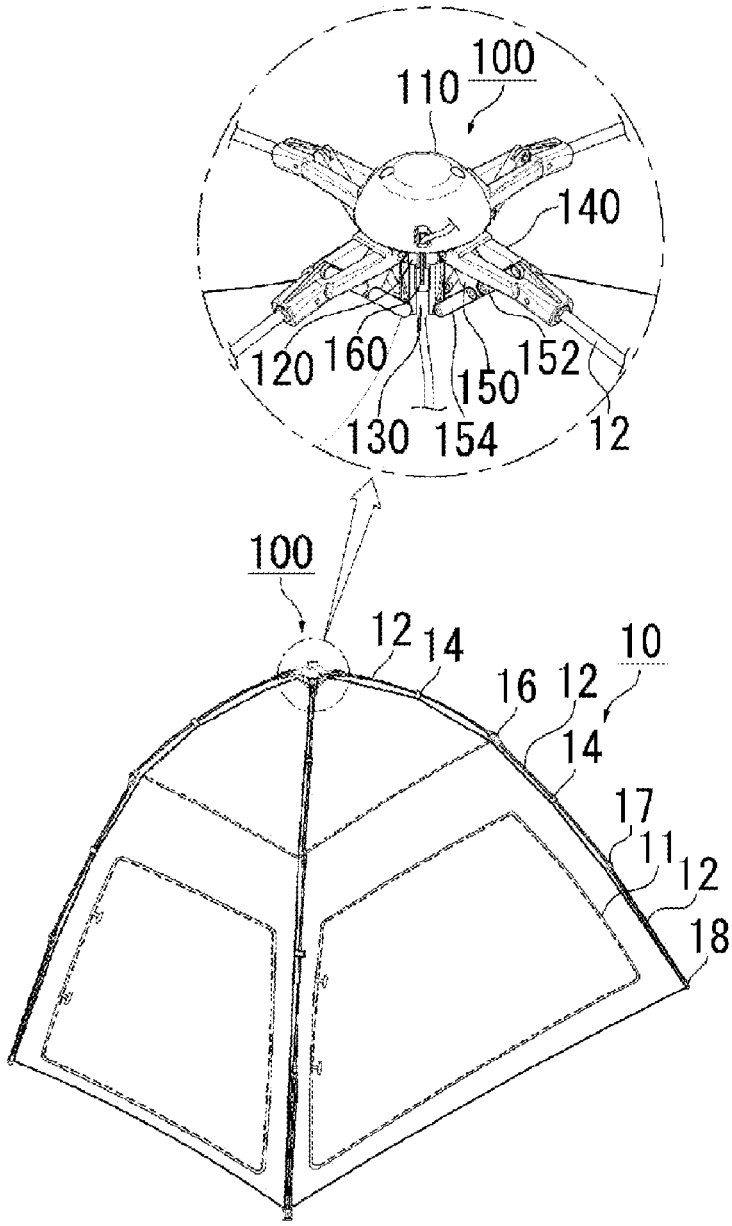
FIG. 2 is a view showing an example of the use of a canopy tent according to a first preferred embodiment of the present invention.
Figure 3:
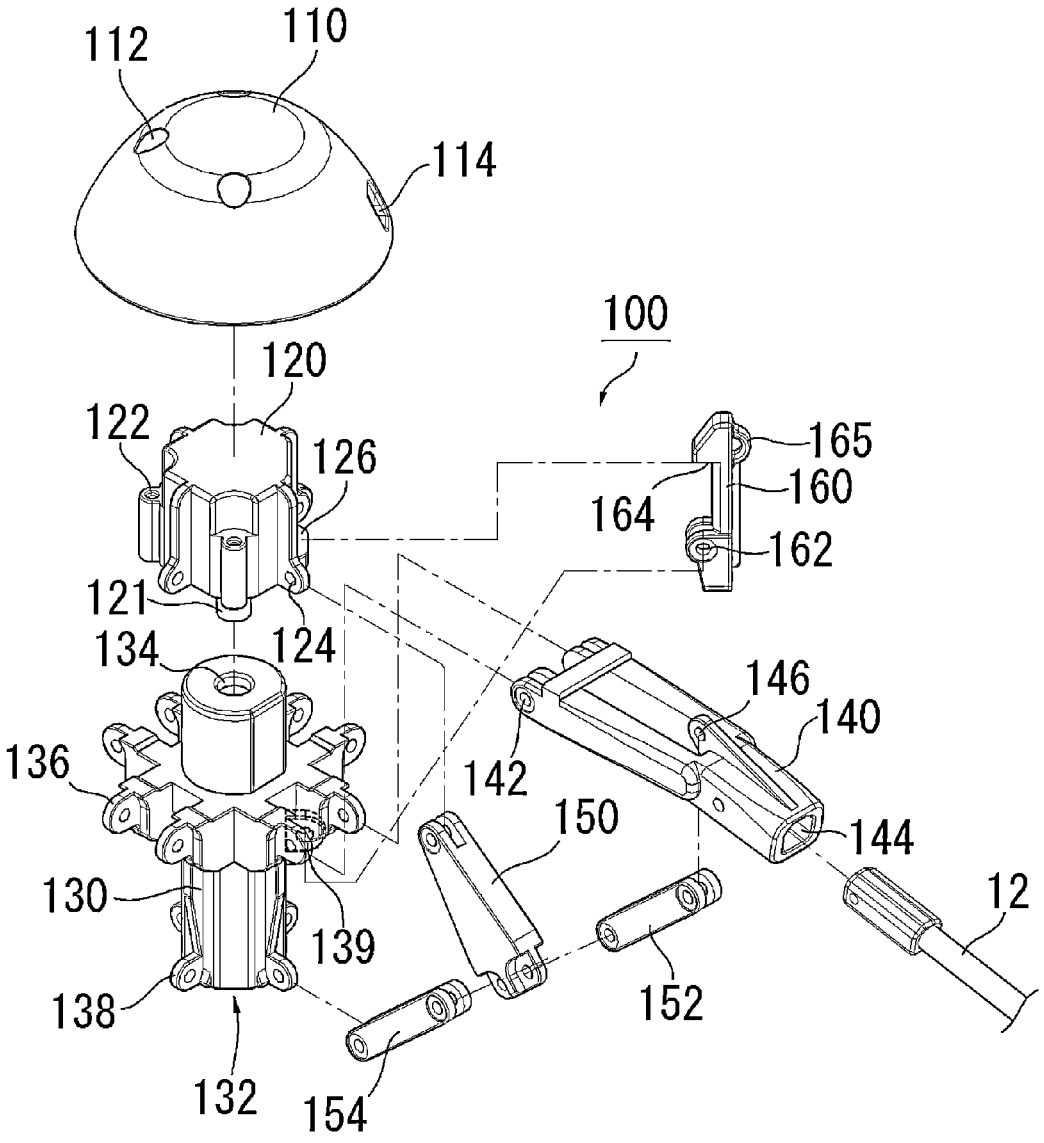
FIG. 3 is a partially exploded view of a connection device according to the first preferred embodiment of the present invention.
Figure 4:
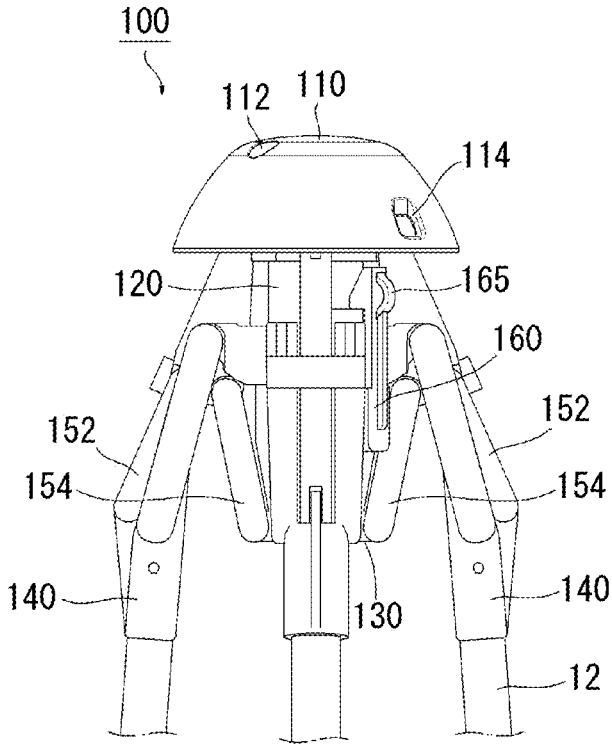
FIG. 4 is a view showing a folded state of the connection device.
Figure 5:
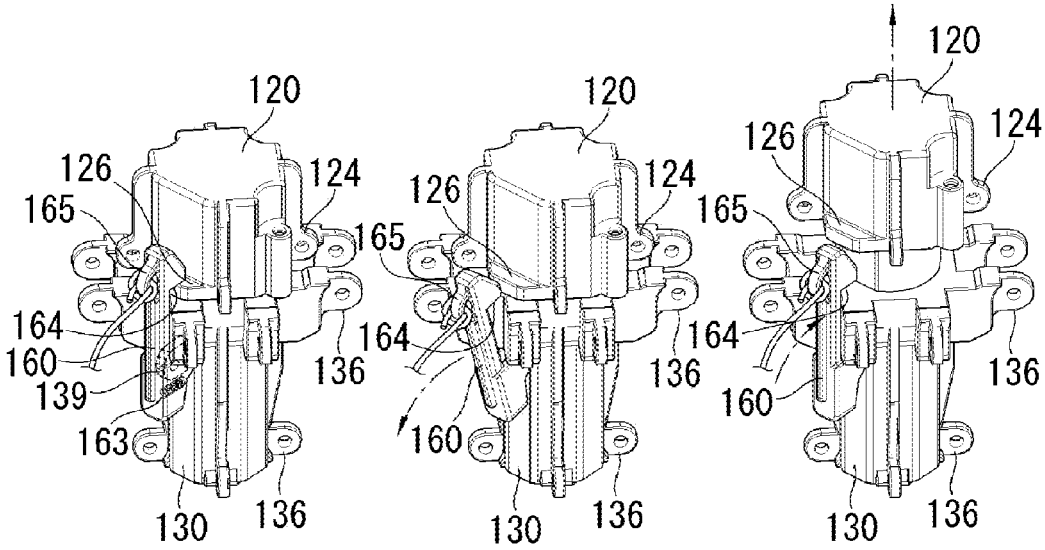
FIG. 5 is a view showing an operation process of a stopper according to the first preferred embodiment of the present invention.

FIG. 2 is a view showing an example of the use of a canopy tent according to a first preferred embodiment of the present invention, FIG. 3 is a partially exploded view of a connection device according to the first preferred embodiment of the present invention, FIG. 4 is a view showing a folded state of the connection device; and FIG. 5 is a view showing an operation process of a stopper according to the first preferred embodiment of the present invention.

First, as shown in FIGS. 2 to 5, the canopy tent according to the present invention includes a tent fabric 11, poles 12, sag preventing members 14, connection members 16 and 17, fixing members 18, and a connection device 100.

The poles 12 constitute a frame of the tent 10 and are mounted in various forms according to the structure and area of the tent fabric 11 produced in various shapes and colors.

At least one sag preventing member 14 is located on a part of the outer face of the tent fabric 11, and the poles 12 are respectively inserted into the sag preventing member 14 to keep the form of the tent fabric 11 as it is when the poles 12 are expanded or folded, so that the tent 10 can be more easily installed or dismantled.

The connection device 100 is mounted on the top of the tent 10 for allowing the poles 12, which are radially expanded, to be expanded or folded in one direction. The connection device 100 includes a cover 110, a sliding member 120, a main body 130, support poles 140, a joint bar 150, a first connection bar 152, a second connection bar 154, and a stopper 160.

The main body 130 of the connection device 100 includes: a hollow interior 132 formed therein, for example, in a cylindrical shape; a plurality of fastening rings 136 and 138 protruding from the outer surface of the central portion and the lower end portion; and a through hole 134 formed on the top thereof for inserting and moving the sliding member 120 therein.

The sliding member 120 includes: a cylinder 121 downwardly protruding from the inner surface thereof for allowing a upward insertion and movement of the main body 130; a joining portion 122 protruding from the outer surface of the central portion thereof for screw-coupling with the cover 110; a plurality of joint rings 124 protruding from the lower end portion thereof and hinge-coupled with the joint bar 150; and a retaining jaw 126, to which the stopper 160 is retained between the joint rings 124, which are formed at the lower end portion thereof, in one direction.

Each of the support poles 140 includes: a pair of hinge portions 142 formed on one side thereof and hinge-coupled to the joint rings 136 and 138 of the main body 130; a pole connection portion 144 for connecting the poles 12 to stand the tent fabric 11 upright; and a joint ring 146 protrudingly formed on the outer face of the pole connection portion 144 and hinge-coupled with the first connection bar 152.

The joint bar 150 has one end hinge-coupled with the joint ring 146 of the sliding member 120 and the other end which has one side hinge-coupled to the first connection bar 152 hinge-coupled to the joint ring 146 of the support pole and the other side hinge-coupled with the second connection bar 154 hinge-coupled to the joint ring 138 of the main body 130.

The cover 110 is screw-coupled to the top of the sliding member 120, and includes a plurality of screw holes 112 formed on the upper portion thereof and a through hole 114 formed on a side of the lower end portion thereof.

The stopper 160 includes: a hinge coupling portion 162 hinge-coupled to a fastening ring 139 formed on the outer surface of the main body 130; an elastic spring 163 mounted at the lower portion of the hinge coupling portion 162; a retaining portion 164 caught to the retaining jaw 126 formed on a side of the lower end portion of the sliding member 120; and a retaining ring 165, which is formed in the opposite direction of the retaining portion 164, and, for instance, to which a cord is connected.

Here, in a state where the retaining portion 164 of the stopper 160 is caught to the retaining jaw 126 of the sliding member 120, when the cord connected to the retaining ring 165 is exposed to the outside through the through hole 114 of the cover 110, the user can release the retained state of the stopper 160 by pulling the exposed cord.

A compression spring 170 and a spring holder 172 are arranged on the hollow interior 132 of the main body 130, the spring holder 172 and the lower portion of the cylinder 121 are screw-coupled with each other, and the cylinder 121 of the sliding member 120 is inserted into the hollow interior 132 from the top of the main body 130, and then, moves vertically therein.

The spring holder 172 has a through hole 174 formed downwardly from the upper portion thereof. When the cord is inserted into the through hole 174 to form a ring and the tent 10 is spread out to be installed, the through hole 174 can help the user to finally install the tent 10 by downwardly pulling the ring.

Figure 6:
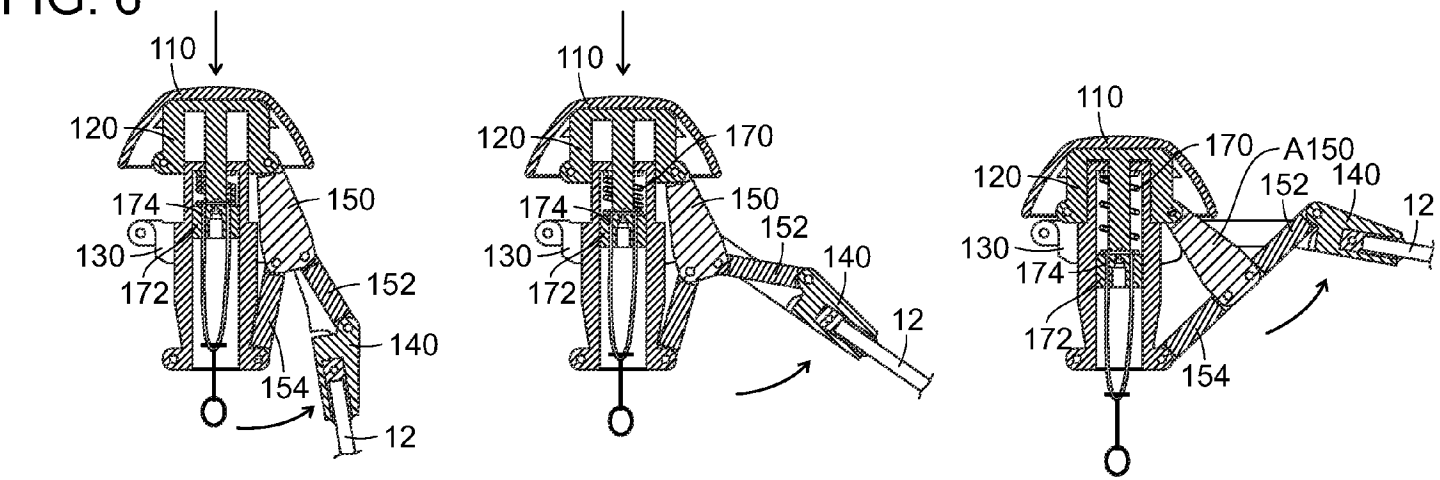
FIGS. 6 and 7 are views showing an operational state of the connection device.
Figure 7:
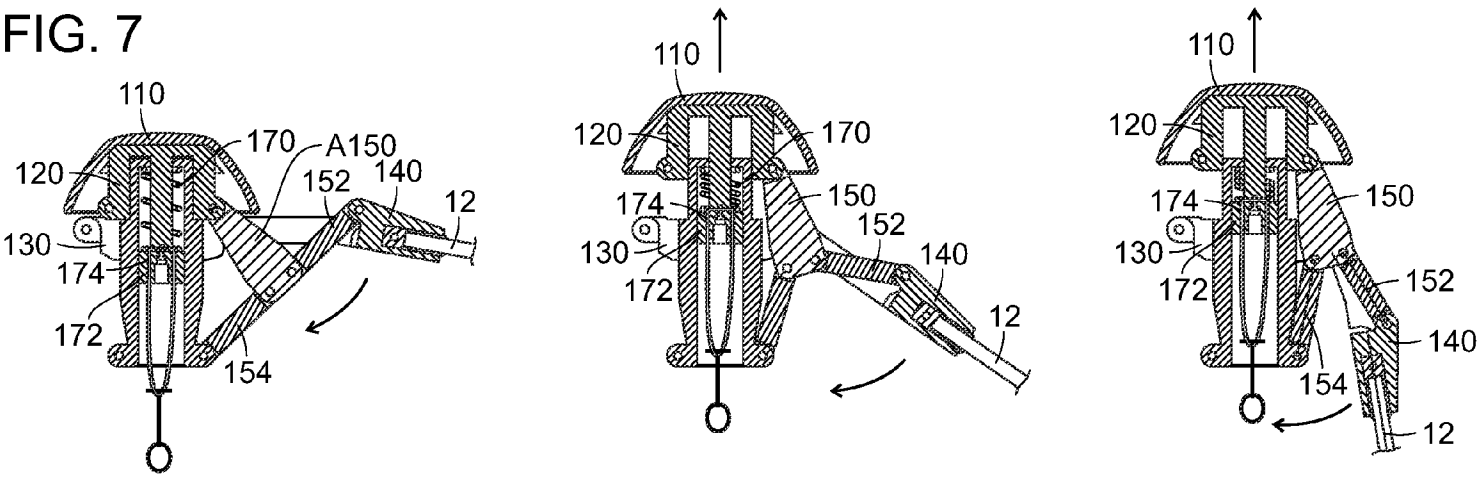

FIGS. 6 and 7 are views showing an operational state of the connection device. In order to install the canopy tent according to the present invention, as shown in FIGS. 6 and 7, when the user grasps the connection device 100, which is located at the top of the folded tent 10, with the hand, and upwardly rotates the support poles 140, which are folded relative to the connection device 100, with the hand, the tent poles 12 connected to the support poles 140 are upwardly expanded.

In this instance, while the compression spring 170 compressed inside the hollow interior 132 of the main body 130 is expanded, the tent poles 12 connected to the support poles 140 can be easily expanded in the upward direction even by a small external force transferred from the user's hand.

Here, when the tent poles 12 connected to the support poles 140 are expanded upwardly, the sliding member 120 slides down, and the joint bar 150 hinge-coupled to the sliding member 120 evenly at regular intervals in a radial direction moves downwardly.

Moreover, while the first and second connection bars 152 and 154 that respectively have one end of which is hinge-coupled with the joint bar 150 and the other end of which is connected to the support poles 140 and the main body 130 are expanded in the upward direction that the support poles 140 are expanded, the support poles 140, the joint bar 150, the first and second connection bar 152 and 154, which are in a folded state, are rotated and expanded upwardly.

After that, in the state that the support poles 140 are expanded at a predetermined angle (for instance, within a range of 70 degrees to 80 degrees) relative to the main body 130, when the user continuously pulls the cord, which is drawn out in the downward direction of the main body 130 and connected to the spring holder 172, in the downward direction, the sliding member 120 lowers to the maximum, and the retaining portion 164 of the stopper 160 mounted on the side of the main body 130 is caught and fixed to the retaining jaw 126 of the sliding member 120.

In the meantime, in order to dismantle the canopy tent, when the user pulls the cord, which is illustrated in FIG. 5 and connected to the retaining ring 165 of the stopper 160 mounted on the side of the main body 130, with the hand, the retaining portion 164 caught and fixed to the retaining jaw 126 of the sliding member 120 is separated from the retaining jaw 126, and hence, the retained condition is removed.

In this instance, while the compression spring 170, which is in an expanded state inside the hollow interior 132 of the main body 130, is compressed, the poles 12, which are connected to the support poles 140 and radially expanded, are folded at a regular angle by their own elastic force.

Here, when the poles 12 connected to the support poles 140 are folded downwardly, the sliding member 120 slidably moves in the upward direction, and the joint bar 150 hinge-coupled to the sliding member evenly at regular intervals in the radial direction are moved in the upward direction.

Furthermore, while the first and second connection bars 152 and 154, each of which has one end hinge-coupled with the joint bar 150 and the other end connected to the support poles 140 and the main body 130, are folded in the downward direction that the support poles 140 are folded, the support poles 140, the joint bar 150, the first and second connection bar 152 and 154, which are arranged around the main body 130, are rotated and folded downwardly.

In the state where the poles 12 connected to the support poles 140 are folded at a predetermined angle (for instance, in the range of 60 degrees to 70 degrees) relative to the main body 130, when the user collects and folds the support poles 140 more relative to the main body 130, the sliding member 120 ascends to the maximum and the support poles 140 are completely folded relative to the main body 130.

After that, the user can connect connection members 16 and 17 between the poles 12 inserted into the sag preventing members 14 of the tent fabric 11 in such a way as to make two-stage or three-stage foldable poles 12. After that, the user folds the poles 12 inwardly or outwardly in one direction, and then, puts and keeps the canopy tent in a case (not shown) after rolling the tent fabric 11 in one direction.

Figure 8:
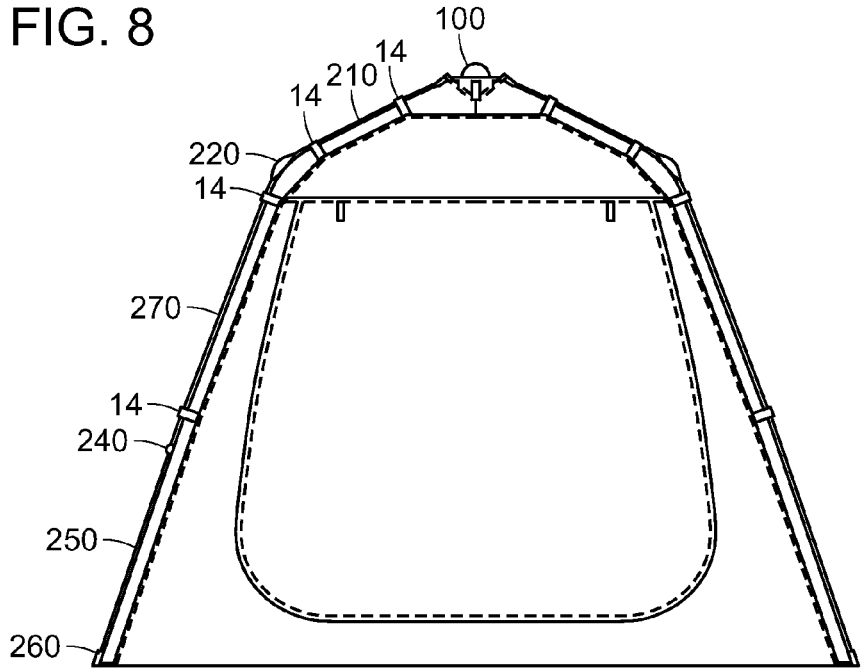
FIG. 8 is a view showing a connected state of poles of the canopy tent according to a second preferred embodiment of the present invention.
Figure 9A:
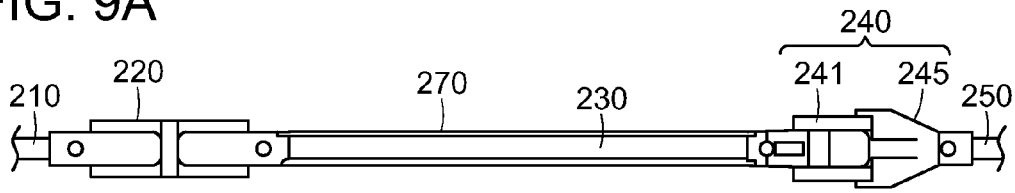
FIG. 9 is a view showing a connected state of poles of the canopy tent according to the second preferred embodiment of the present invention.
Figure 9B:
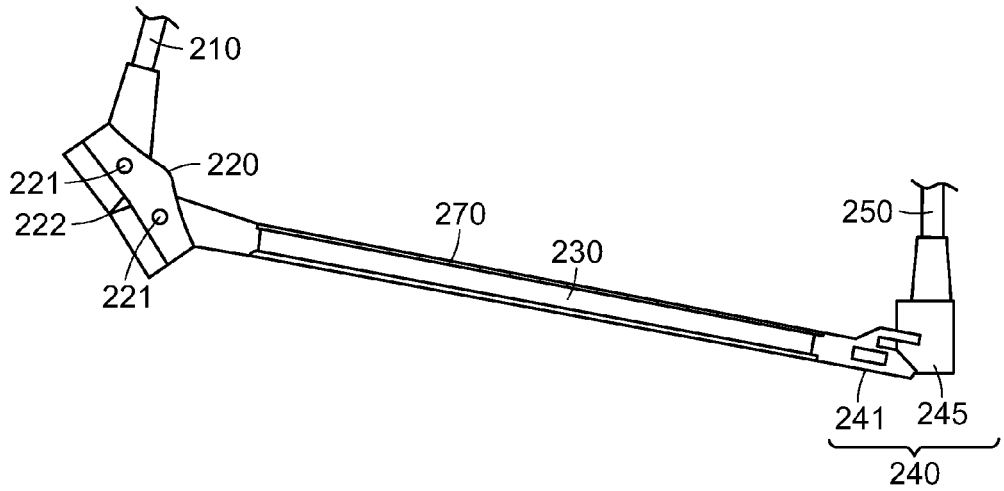
Figure 10:
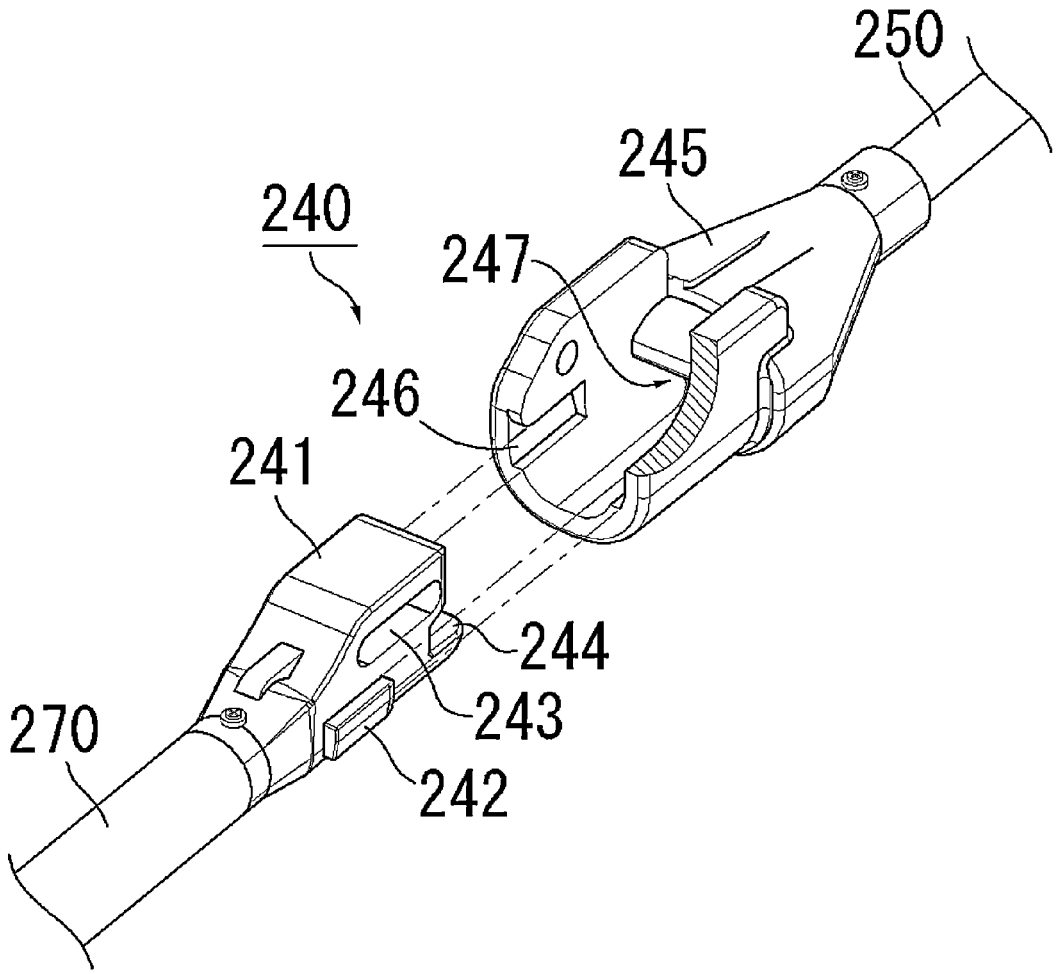
FIG. 10 is an exploded view of a second joint member according to the second preferred embodiment of the present invention.
Figure 11:
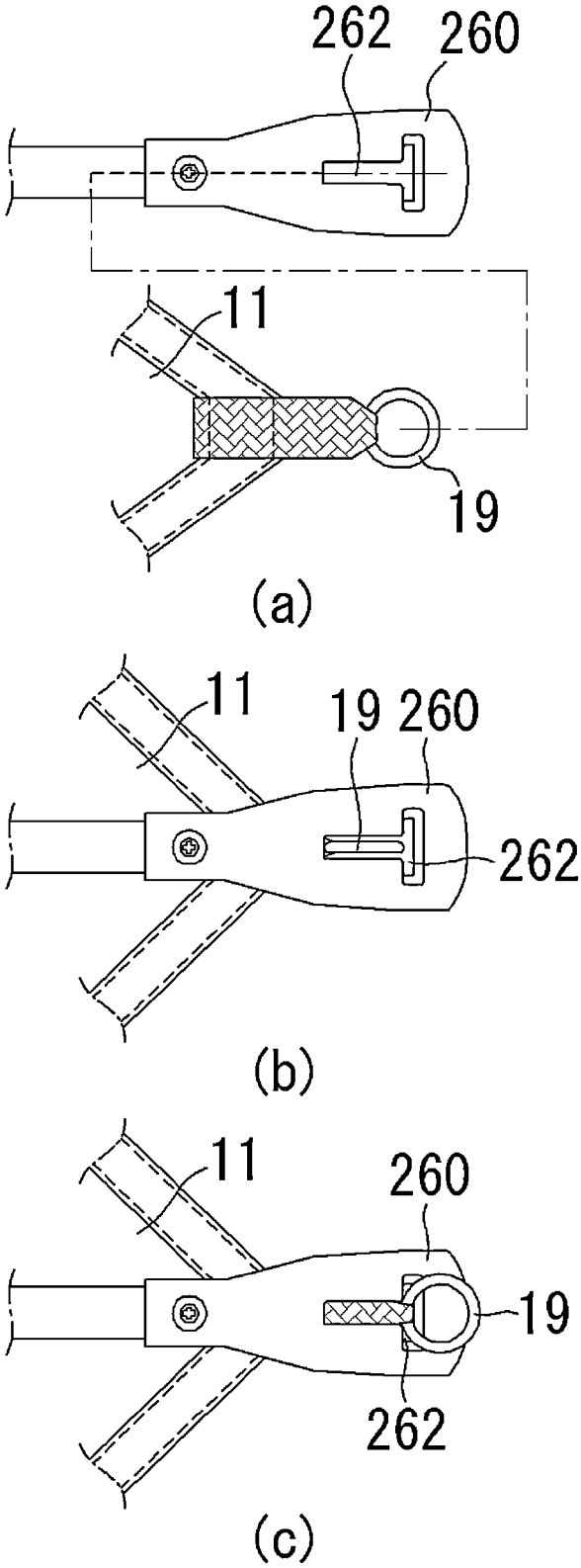
FIG. 11 is view showing a used process of a fixing member according to the second preferred embodiment of the present invention.

Meanwhile, FIG. 8 is a view showing a connected state of poles of the canopy tent according to a second preferred embodiment of the present invention, FIG. 9 is a view showing a connected state of poles of the canopy tent according to the second preferred embodiment, FIG. 10 is an exploded view of a second joint member according to the second preferred embodiment, and FIG. 11 is view showing a used process of a fixing member according to the second preferred embodiment.

As shown in FIGS. 8 to 11, the canopy tent according to the second preferred embodiment of the present invention includes first poles 210, first joint members 220, second poles 230, second joint members 240, third poles 250, fixing members 260, and flexure preventing pipes 270.

The connection device is mounted on the top of the tent 10 for allowing the first poles 210 expanded radially to be expanded or folded in one direction, and each of the first poles 210 has one end hinge-coupled through the support poles 140 connected with the connection device 100 located at the top of the tent 10 and the other end hinge-coupled to each of the first joint members 220.

Each of the first joint members 220 includes: hinge coupling portions 221 formed at both sides thereof and joined to the first pole 210 and the second pole 230; and a pole supporting portion 222 for supporting and preventing the first pole 210 and the second pole 230 joined to the hinge coupling portion 221 from being rotated at a predetermined angle, for instance, within the limit of 200 degrees to 220 degrees.

Each of the second poles 230 has one end hinge-coupled to the first joint member 220 and the other end fixed to the second joint member 240.

Each of the second joint member 240 includes a coupling member 241 coupled with the second pole 230 and a rotation member 245 coupled with the third pole 250.

The coupling member 241 has guide projections 242 formed at both sides thereof, an elongated hole 243 to which the rotation member 245 is hinge-coupled, and a fixing projection 244 formed on the lower end portion of the front face meeting the rotation member 245.

The rotation member 245 has an open upper portion, guide grooves 246, which are formed on the inner surface of both sides of the rotation member 245 and correspond to the guide projections, and a fixing hole 247 corresponding to the fixing projection 244.

Each of the third poles 250 has one end joined to the second joint member 240 and the other end fixed to the fixing member 260.

Each of the fixing members 260 has, for instance, a T-shaped through hole 262, and a fixing ring 19 mounted at an edge portion of the lower end portion of the tent 10 is, as shown in FIGS. 11(*a*) and (*b*), inserted and fit in a longitudinal direction of the T-shaped through hole 262, and as shown in FIG. 11(*c*), rotated at an angle of 90 degrees toward a head portion of the T-shaped through hole 262, and then, is fixed.

The flexure preventing pipe 270 is mounted on the outer face of the second pole 230 mounted between the first joint member 220 and the second joint member 240 to prevent the outward flexure of the second pole 230, so that the side of the canopy tent can keep a straight form as shown in FIG. 8.

As described above, the canopy tent according to the present invention is configured in such a way that the tent poles can be easily folded or expanded relative to the central axis of the tent in a state where the poles are connected with one another, and hence, can be rapidly installed and dismantled.

Additionally, the canopy tent according to the present invention can be conveniently installed and dismantled with a small power and can prevent that the installed tent is collapsed by the external force or stumbled by a draft of air.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A canopy tent comprising:

a connecting device;

a plurality of tent poles being pivotally connected to the connecting device;

the connecting device comprising:

a main body having a plurality of joint rings formed on an outer surface thereof and a hollow interior;

a sliding member having a plurality of joint rings formed on an outer surface thereof and a downwardly protruding cylinder formed therein;

support poles, each having one end, which is hinge-coupled to the joint ring of the main body, and another end, which is connected to one of the corresponding tent pole for standing the canopy tent upright, and which has a joint ring formed on an outer face of a pole connection portion;

a joint bar having one end pivotally connected to the corresponding joint ring of the sliding member and another end having one side coupled to a first connection bar hinge-coupled to the joint ring of the support pole and another side coupled to the second connection bar hinge-coupled to the joint ring of the main body; and a compression spring and a spring holder coupled to a lower portion of the cylinder of the sliding member, the cylinder of the sliding member being slidably fitted into the hollow interior of the main body from a though hole on a top of the main body, wherein the compression spring is equipped within the hollow interior of the main body by the spring holder such that the cylinder is movable in upward and downward directions with respect to the main body.

2. The canopy tent according to claim 1, wherein the sliding member further comprises a retaining jaw, which is formed on a side of a lower end portion of the sliding member, and a stopper is pivotally connected to a fastening ring, which is formed on the outer surface of the main body, and the stopper having a retaining portion to caught with the retaining jaw for retaining the sliding member.

3. The canopy tent according to claim 2, wherein a cover is connected to a top of the sliding member, and the cover has a through hole formed on an upper face thereof to allow a user to connect a cord to a retaining ring formed on one side of the stopper caught to the retaining portion of the sliding member to thereby release the stopper.

4. The canopy tent according to claim 1, wherein the spring holder comprises a through hole to allow the user to insert a cord into the through hole to form a ring so that the user can install the tent by downwardly pulling the ring.

5. The canopy tent according to claim 4, wherein each of the tent poles comprises:

a first pole having one end hinge-coupled with the connection device located on the top of the tent and the other end joined to a first joint member;

a plurality of second poles, each having one end joined to the first joint member and the other end fixed to a second joint member;

a plurality of third poles, each having one end joined to the second joint member and the other end fixed to a fixing member; and a flexure preventing pipe mounted on an outer face of the second pole for preventing flexure of the second pole, wherein the fixing member is joined with the third pole and has a T-shaped through hole.

* * * * *